US010103430B2

(12) United States Patent
Lenk

(10) Patent No.: US 10,103,430 B2
(45) Date of Patent: Oct. 16, 2018

(54) ANTENNA COVER, USE OF AN ANTENNA COVER, ADAPTER FOR CONNECTING TWO ANTENNA COVERS AND METHOD FOR PRODUCING A LENS-SHAPED ANTENNA COVER

(71) Applicant: VEGA GRIESHABER KG, Wolfach (DE)

(72) Inventor: Fritz Lenk, Schiltach (DE)

(73) Assignee: VEGA GRIESHABER KG, Wolfach (DE)

( * ) Notice: Subject to any disclaimer, the term of this patent is extended or adjusted under 35 U.S.C. 154(b) by 0 days.

(21) Appl. No.: 15/534,502

(22) PCT Filed: Dec. 11, 2014

(86) PCT No.: PCT/EP2014/077388
§ 371 (c)(1),
(2) Date: Jun. 9, 2017

(87) PCT Pub. No.: WO2016/091313
PCT Pub. Date: Jun. 16, 2016

(65) Prior Publication Data
US 2017/0331183 A1 Nov. 16, 2017

(51) Int. Cl.
*H01Q 1/22* (2006.01)
*H01Q 13/02* (2006.01)
(Continued)

(52) U.S. Cl.
CPC ..... *H01Q 1/422* (2013.01); *H01Q 1/225* (2013.01); *H01Q 13/02* (2013.01); *H01Q 15/08* (2013.01)

(58) Field of Classification Search
CPC ..... H01Q 1/422; H01Q 1/225; H01Q 13/02; H01Q 15/02; H01Q 15/04; H01Q 15/06; H01Q 15/08; H01Q 15/10
See application file for complete search history.

(56) References Cited

U.S. PATENT DOCUMENTS 2,627,027 A * 1/1953 Kock ..... H01Q 15/08 333/35
4,220,957 A * 9/1980 Britt ..... H01Q 19/065 343/755
(Continued)

FOREIGN PATENT DOCUMENTS

DE 10 2006 030 965 A1 1/2008
EP 2 031 700 A1 3/2009
(Continued)

OTHER PUBLICATIONS

International Preliminary Report on Patentability and Written Opinion dated Jun. 22, 2017 in PCT/EP2014/077388 (English translation only).
(Continued)

*Primary Examiner* — Dameon E Levi
*Assistant Examiner* — Jennifer F Hu
(74) *Attorney, Agent, or Firm* — Oblon, McClelland, Maier & Neustadt, L.L.P.

(57) ABSTRACT

An antenna cover is provided, including a first base body and at least two first fins arranged on the first base body, the first base body having a curved surface, the two first fins being arranged symmetrically to a longitudinal axis of symmetry of the antenna cover and extending substantially parallel to the longitudinal axis of symmetry, the at least two first fins having a width that tapers as a distance from the first base body increases, and the at least two first fins being arranged with a spacing that corresponds substantially to the width of the at least two fins. A method for producing a lens-shaped antenna cover is also provided.

12 Claims, 6 Drawing Sheets

(51) Int. Cl.
*H01Q 1/42* (2006.01)
*H01Q 15/08* (2006.01)

(56) References Cited

U.S. PATENT DOCUMENTS

| | | | | | |
|---|---|---|---|---|---|
| 4,769,646 | A * | 9/1988 | Raber | H01Q 19/06 | 343/753 |
| 5,262,743 | A | 11/1993 | Jean | | |
| 5,606,334 | A * | 2/1997 | Amarillas | H01Q 19/065 | 343/753 |
| 6,313,802 | B1 * | 11/2001 | Petersson | H01Q 15/04 | 343/753 |
| 2003/0016539 | A1 * | 1/2003 | Minano | F21V 7/04 | 362/347 |
| 2006/0202909 | A1 * | 9/2006 | Nagai | H01Q 15/08 | 343/911 R |
| 2009/0058749 | A1 | 3/2009 | Shimoi et al. | | |
| 2010/0090883 | A1 | 4/2010 | Chen et al. | | |
| 2012/0262331 | A1 * | 10/2012 | Kienzle | B29C 45/2624 | 342/124 |

FOREIGN PATENT DOCUMENTS

| | | |
|---|---|---|
| EP | 2 515 376 A1 | 10/2012 |
| GB | 1 410 699 | 10/1975 |

OTHER PUBLICATIONS

International Search Report dated Oct. 16, 2015 in PCT/EP2014/077388, filed Dec. 11, 2014.

* cited by examiner

ANTENNA COVER, USE OF AN ANTENNA COVER, ADAPTER FOR CONNECTING TWO ANTENNA COVERS AND METHOD FOR PRODUCING A LENS-SHAPED ANTENNA COVER

FIELD OF THE INVENTION

The present invention relates to the technical field of fill level measurement. In particular, the present invention relates to an antenna cover, to the use of an antenna cover for the construction of a lens, to an adapter and to a method for producing a lens-shaped antenna cover.

TECHNOLOGICAL BACKGROUND

Fill level measuring devices often use antennas to bundle electromagnetic rays and to specify a direction of propagation of the electromagnetic rays, which are transmitted in the direction of a filling material. The reflections of the electromagnetic rays on the surface of a filling material are utilised to determine a fill level or the height of a bulk material. A filling material can thus be a material which is put into a container or a material that lies on an open space as a bulk material. Since the antennas are often implemented as horn antennas and are also frequently used in dirty environments, covers are used for the horn antennas in order to prevent dirt particles from getting inside the horn antenna. In addition to the protective effect against penetrating particles, the covers can also be used for beam formation, especially if they are manufactured from plastics material and have a suitable lens shape.

A dielectric lens is known from printed publication GB 1 410 699 and is suitable for bundling radio radiation.

Printed publication EP 2 515 376 A1 relates to an antenna cover for a fill level measuring device.

On account of the different thicknesses of a lens, however, production by injection moulding is difficult and lenses are therefore produced as turned parts.

SUMMARY OF THE INVENTION

It may be considered a requirement to facilitate effective protection for fill level measuring devices.

According to one aspect of the present invention, an antenna cover, use of an antenna cover for the construction of a lens, an adapter, an injection mould and a method for producing an antenna cover are described.

The subject matter of the invention results from the features of the independent claims. Exemplary embodiments result from the subjects of the dependent claims and the following description.

According to one aspect of the present invention, an antenna cover is described, which has a first base body and at least two first fins, which are arranged on the base body. The first base body has a curved surface. The curved surface is formed, for example, to change the direction of propagation of an electromagnetic wave or radiation that passes through it. In one example the curved surface may have one or a plurality of specifiable radii of curvature, the centre point/points of which lies/lie on a longitudinal axis of symmetry of the antenna cover.

The at least two first fins are arranged symmetrically to the longitudinal axis of symmetry of the antenna cover and extend substantially parallel to the longitudinal axis of symmetry. The fins substantially point away from the curved surface. In other words, the orientation of the fins having a normal vector to the curved surface may have an angle that lies in the range between +90° and −90°, inclusive of 0° and exclusive of ±90°, or which lies in the range between +90° and −90°, inclusive of 180° and exclusive of ±90°. The at least two first fins have a width that tapers as the distance from the base body increases. In other words, the fins may be formed conically. The tapered shape may ensure that the fins are substantially pointed and form a draft angle that make possible easy removal of the antenna cover from an injection mould. The draft angle may be formed between a fin wall and the longitudinal axis of symmetry or a parallel to the longitudinal axis of symmetry. The draft angle may lie in the range of 0° to 5°, in the range of 0.5° to 5° or in a range from 0° to 10°, without 0° being included. The draft angle may ensure that during removal of the antenna cover from an injection mould, the walls of the injection mould and the fins separate from one another at an early stage, in order to ensure low friction along a predominant part of the removal path. The removal path may substantially correspond to the length of the respective fins.

The at least two first fins are arranged with a spacing that substantially corresponds to the width of the at least two fins (102*a*, 102*b*).

In one example, an antenna cover is specified, which has a first base body and an even number of at least two first fins. The base body has a curved surface with a specifiable radius of curvature. The radius of curvature may depend, for example, on an antenna width, the material of the antenna cover and/or a frequency of an electromagnetic wave that is to be transmitted through the antenna cover.

The radius of curvature of the curved surface of the first base body is located on a longitudinal axis of symmetry of the antenna cover. The longitudinal axis of symmetry may also be a longitudinal axis of an associated antenna and in particular the longitudinal axis of symmetry may be oriented to a direction of propagation of an electromagnetic wave that passes through the antenna cover. The at least two first fins are arranged symmetrically to the longitudinal axis of symmetry and extend substantially parallel to the longitudinal axis of symmetry. The at least two first fins substantially have a width that corresponds to a spacing with which the at least two first fins are arranged relative to one another. If the base surface of the base body is understood as a matrix, then due to the uniform width of the spacings and fins a regular matrix may result, wherein matrix positions are periodically occupied and free. The matrix can be a grid-like matrix, a chequered matrix, a circular matrix having concentric circles and/or an elongated matrix. The free matrix positions can also be termed gaps or spacings. The two symmetrical fins lying closest to one another may be spaced apart by precisely one spacing. The longitudinal axis of symmetry may run through this spacing.

According to another aspect of the present invention, the use of an antenna cover according to the invention for the construction of a lens is described. The antenna cover may utilise the at least two fins as an attachment means or as a joining means. This attachment means can be brought into engagement with a corresponding attachment means of a further antenna cover in such a way that the curved surface of the first base body can be used for the refraction of electromagnetic waves or rays that impinge on the curved surface. Due to the interaction with the further antenna cover, which provides a further curved surface, a lens having two symmetrical refractive surfaces can be produced by the meshing of the attachment means. During production of the lens, the fins of the antenna cover come to lie within the corresponding spacings of the further antenna cover and vice versa. Since the spacings are not filled with material, they are filled in each case with material by the suitably adapted fins of the other attachment means. A lens-shaped solid body is formed by the plugging together or joining. Draft angles are formed by the tapered shape of the fins. The draft angles present may be used for simple joining and easy escape of air between the constituents of the finished lens. In one example, an adhesive can be used to facilitate air-free joining of the lens halves.

To be able to interact with the corresponding number of at least two first fins, the other antenna cover may have a number of first fins that differs by the value 1. In particular, in the case of an odd number of at least two first fins, the other antenna cover may have an elevation in a centre point or in the longitudinal axis of symmetry that lies opposite a curved surface of the further antenna cover. This elevation or this central fin can be fitted into the spacing of the antenna cover with the even number of at least two first fins, which spacing is formed around the longitudinal axis of symmetry, and fill this spacing or this gap. The spacing may expand with increasing distance from the base body. The spacing through which the longitudinal axis of symmetry runs can be used to align the antenna covers relative to one another, in order to create a symmetrical lens shape. Flanges or guides, which aid a precise assembly of the lens, can be provided for alignment purposes in an edge area of the antenna cover and/or of the further antenna cover.

According to another aspect of the present invention, an antenna for a measuring device, in particular for a fill level measuring device, for a flowmeter, for a temperature gauge or for a pressure gauge is specified. The antenna may be formed as a horn antenna.

According to another aspect of the present invention, an adapter is described, which is used to connect at least two antenna covers. This adapter has an adapter base body and a plurality of fins, wherein the plurality of fins is arranged symmetrically on the adapter base body. The adapter body can be regarded as a mirror face or plane of symmetry for the fins. The plurality of fins has a width that tapers as the distance from the base body increases. In one example, the plurality of fins is arranged symmetrically not only to the adapter base body and/or a mirror axis of the adapter base body, but also to a longitudinal axis of symmetry of the antenna cover. The longitudinal axis of symmetry may stand perpendicular on the mirror axis of the adapter base body in an assembled state of the lens. The longitudinal axis of symmetry of the adapter may coincide with the longitudinal axis of symmetry of the antenna cover in an installed state. It may be possible by means of such a symmetrically constructed adapter to combine antenna covers of the same kind to form a lens.

According to another aspect of the present invention, an injection mould may be described, which is configured to produce the antenna cover according to the invention and/or to produce the adapter according to the invention. In particular, the injection mould is configured to produce the antenna cover and/or the adapter by means of an injection moulding process from a plastics material in the injection moulding process and for this has a negative image of the antenna cover and/or of the adapter. The injection mould may have draft angles corresponding to the draft angles of the antenna cover for easy removal. The injection mould may have fins that taper in the region of the spacings or gaps. The injection mould can have the negative shape of the antenna cover and of the adapter, so that the antenna cover and the adapter can be produced at the same time.

The term "negative image" may basically mean that at locations at which material is present, a recess is present in the injection mould, while at locations at which no material is present or material is missing in the finished part, material is present in the injection mould. The injection mould may consequently be designed so that at the locations of the spacings the injection mould has material that corresponds to the shape of the spacings, while the injection mould accordingly has no material at locations where there are fins. The locations without material or the gaps in the injection mould may correspond to the shape of the at least two fins. The curved surface in the injection mould may also be implemented as an oppositely curved surface. For example, a convex surface may be formed as a concave surface in the injection mould.

A method for producing the antenna cover by means of an injection moulding process may be described in one example. To produce the antenna cover, an injection moulding machine and the injection mould according to the invention are provided, likewise the granulate of which the antenna cover is to consist. Examples of the material to be used, which can be processed by injection moulding and allows electromagnetic waves to pass, are PP (polypropylene), PEEK (polyether ether ketone) or PTFE (polytetrafluoroethylene). PFA (perfluoroalkoxy), PVDF (polyvinylidene fluoride), POM (polyoxymethylene), PPS (polyphenylene sulfide), PP (polypropylene) and/or PTFE (polytetrafluoroethylene) are also possible. The antenna cover or the lens halves can also be produced from a combination of at least two different materials. The cost of the material, the stability and the HF properties may be used as selection criteria in this case.

By forming fins and the base body with substantially identical material thicknesses, a uniform cooling can take place following the moulding of the objects by means of an injection mould. In one example, a fin may have a width of 60% to 80% or of 70% of the thickness of the base body. The width of a fin may be 4 mm in one example.

The antenna cover can be considered as a partial antenna cover, and thus as a part of a lens for an antenna, which is produced in multiple parts. A lens can be designed in the manner described in such a way that is can be produced easily by injection moulding.

When designing the partial lens or the antenna cover according to the invention and in particular the associated injection mould, care should be taken to ensure that the antenna cover can be moulded without shrinking or without voids from the injection mould. In the case of a one-piece lens, it may be laborious to design this in such a way that simple production by injection moulding is possible. The two-part or multipart production of the lens can make low-cost production by injection moulding possible and can prevent lenses from having to be produced expensively as turned parts on a lathe.

The antenna cover, the partial lens and in particular the finished lens parts and the adapter can be assembled into a lens, which has substantially the same properties as a lens produced from solid material. Due to the meshing of fins and spacings or gaps between the fins, the spacings can be filled again to give a solid body when joining the lens parts and the combination of spacings and fins can complement one another to form a solid body. Small gaps can be disregarded, especially in the frequency ranges of the electromagnetic waves used for fill level measuring devices, which may lie outside the optically visible range, for example in the range between 1 GHz and 100 GHz, between 24 GHz and 27 GHz and in particular at 23.5 GHz, 50 GHz or 100 GHz. Due to the mutual complementing of the lens parts, a lens filled with material can be realised in spite of production by means of injection moulding.

The spacings or gaps between the fins and the fins themselves may be used to join the lens parts together and therefore be described as a joining contour. On joining, a tolerance range may be set in particular in such a way that the fins engage by means of a press fit in the spacings or gaps of the respective other antenna cover and are thus secured against displacement. On joining, the crown regions of one antenna cover may come into contact with the valley regions of the other antenna cover and vice versa, so that walls, crown regions and valley regions substantially corresponding to one another touch each other.

The wall thickness of the base body and/or of the fins may be oriented to the stipulations for the injection technique used in each case. Overall, the base body and the at least two first fins may be formed so that material accumulations and shrink marks are minimal. Shrink marks are disturbances of the surface that do not follow the desired moulding on account of the material shrinkage of the cooling process. These shrink marks can occur in the case of significantly different wall thicknesses. Fins can be provided in the injection moulding process for support. The longer the fins are formed, the more easily they can be damaged. Due to the substantially complete joining to one another and the creation of a solid body, fins of the assembled antenna covers in the construction presented can be mutually stabilised, so that they can be formed long in spite of the use of an injection moulding process. Thus it may also be possible that the crown regions of the fins also create a lens shape substantially symmetrically to the curved surface. The fins are formed as homogeneously as possible, so that they form a unit with the base body.

For lenses or antenna covers that are used in the range between 2 GHz and 79 GHz, wall thicknesses of 4 mm can be used. Thus, for example, the fins and/or the base body can have a wall thickness between 0 and 4 mm, between 2 mm and 4 mm or between 3 mm and 6 mm. In one example, the thickness of a fin can have 0.7 times the thickness of the base body at the thinnest point. To facilitate simple production by injection moulding, the walls of the spacings and/or of the fins in one example may not run straight in the direction of the longitudinal axis, but may taper. In other words, this may mean that spacings in the direction from the joining region to the base body become smaller. The fins may taper in a direction pointing away from the base body. The tapering of the fins and spacings therefore takes place in the opposite direction.

The joining contour can be configured so that different joining methods can be used to join the lens halves or the antenna covers together. For joining, the lenses can be held together by screwing, clamping via conical faces, pressing, gluing and clamping in installation. On clamping, the close proximity of the side faces of the fins to one another in the installed state may cause high friction, which makes coming apart difficult. In the case that an adhesive is used for assembling the lens halves or lens parts, it may be ensured in a quality control step that air inclusions are reduced in that they are filled with material or adhesive. However, the joining can also take place under vacuum or in a vacuum with the simultaneous application of heat. In one example, the antenna covers or the lens parts may be heated and be joined by the cooling. An entire antenna for a fill level measuring device may thus be producible by an injection moulding process.

In blind places or in valley regions such as occur, for example, in the spacings between the fins, care may need to be taken that large circles or radii are used to facilitate uniform cooling without shrink marks. This may mean that an imaginary virtual circle drawn between the curved surface and two adjacent valley regions of two spacings has a large diameter. By using wall thicknesses that are as identical, constant or homogeneous as possible both for the base body and for the fins, a uniform cooling and curing of the injection material may be supported.

According to another aspect of the present invention, the curved surface may be a curved surface with aspherical curvature.

An aspherically curved surface may have not only a single radius of curvature but a plurality of radii of curvature. The respective centre points of the radii of curvature can lie on the longitudinal plane of symmetry in one example. The curved surface may be divided up into regions of different curvature.

According to another aspect of the present invention, the antenna cover has an even number of at least two fins. The number of the at least two first fins is therefore an even number.

The even number of at least two fins may make it possible to interact with a cover having an odd number of fins and form a complete lens. In particular, two refraction surfaces running symmetrically can be provided in this way. A central fin can come to rest in a gap between at least two symmetrically arranged fins and form a solid body.

According to another aspect of the present invention, the longitudinal axis of symmetry may lie in a plane of symmetry, wherein the first base body and the at least two first fins are arranged in mirror symmetry to the plane of symmetry.

The fins can be formed on the first base body as concentric circles, or also as fins running in parallel or fins running linearly. In the production of cylindrical lenses in particular, fins running in parallel may be used over the length of the lens as joining contours. The use of fins running in parallel can facilitate the joining of the lens halves in the event of limited heights, in that the lens parts are pushed onto one another, while for assembling lens parts with fins arranged with circular symmetry, raising of the lens parts is necessary.

According to another aspect of the present invention, the fins may be arranged in a comb-like manner along the width of the first base body. In the case of fins arranged in a circular shape in particular, a cross section through the joining contour may have a comb-like shape. The comb-like shape can enable constant wall thicknesses to be maintained.

According to another aspect of the present invention, the spacing has a valley region or base region, wherein the valley region lies on a parallel surface to the curved surface.

By way of example, the spacing or the gap between two adjacent fins has a valley region, which lies on a second radius of a circle, which has the same origin as the radius of curvature or circle of curvature, but is smaller than the radius of curvature. The difference between the second radius and the radius of curvature may correspond to the thickness of the base body at the thinnest point and thus depend on the injection moulding process used, on the wall thickness of the fins used and/or on the spacings. The valley regions are thus oriented on the curved shape in such a way that the wall thicknesses, which are easy to produce by injection technology, can be maintained. In another example, the surface on which the valley regions lie may run substantially parallel to the curved surface and also be formed aspherically if necessary. Ventilation openings can be provided, which ensure an easy escape of air on joining. Alternatively, the joining may take place in a vacuum chamber, so that the escape of air can be ensured.

According to another aspect of the present invention, the at least two fins each have a crown region, wherein each of the crown regions follows a virtual mirrored curved surface of the base body less a thickness of the base body. The mirrored curved surface of the base body and the curved surface of the base body have a mirror axis and/or a mirror plane, which lies perpendicular to the longitudinal axis of symmetry of the antenna cover.

In other words, the valley region of the spacings and the crown region of the fins can be considered as a support point of an envelope curve or enveloping surface. The corresponding envelope curve or enveloping surface may run parallel to the curved surface of the base body. The envelope curve of the valley regions and the envelope curve of the crown regions may be symmetrical with regard to the mirror axis and/or the mirror plane. Starting out from a full lens, the envelope curve of the valley regions and the envelope curve of the crown region may in each case run parallel to the associated refraction surface of the full lens, reduced by the wall thickness of the base body at the thinnest point. Corresponding valley regions and crown regions of the two antenna cover halves may come to rest on one another in this way upon joining, so that air inclusions are substantially avoided and a homogeneous solid body is formed.

According to another aspect of the present invention, the antenna cover has a second antenna cover, which has a second base body and a plurality of second fins. The number of the plurality of second fins of the further antenna cover differs from the number of the at least two first fins by the value 1. The plurality of second fins has a width and/or form that substantially corresponds to the spacing of the at least two first fins and tapers with increasing distance from the second base body. The plurality of second fins of the second antenna cover is arranged at a spacing from one another that substantially corresponds to the width of the at least two first fins. The plurality of second fins of the second antenna cover engages according to their number in each case in a spacing or in a gap in the antenna cover.

It may thus be possible to form a homogeneous solid body for a lens with a minimal volume of air inclusions.

In one example, the antenna cover has a further antenna cover, which has a second base body and an odd number of second fins. The odd number of second fins of the further antenna cover comes to lie in the spacings of the antenna cover upon assembly into a lens. The antenna cover and the further antenna cover may be formed as parts of a lens and complement each other by the joining to form a lens as a solid body.

According to another aspect of the present invention, the at least two first fins may be arranged as concentric circles and/or as parallel fins.

According to another aspect of the present invention, the width of each of the at least two first fins corresponds substantially to the thickness of the base body in the region of a valley region of the spacing. The valley region of a spacing can also be described as the crown region of the spacing and may designate the point at which the wall thickness of the base body is thinnest.

It should be noted that different aspects of the invention were described with reference to different subjects. In particular, some aspects were described with reference to apparatus claims, whereas other aspects were described with reference to method claims. However, a person skilled in the art can infer from the above description and the following description that, unless otherwise described, in addition to each combination of features that belongs to a subject matter category, also each combination between features that relates to different subject matter categories is regarded as disclosed by the text. In particular, a combination between features of apparatus claims and features of method claims is also to be disclosed.

BRIEF DESCRIPTION OF THE DRAWINGS

Further exemplary embodiments of the present invention are described in the following with reference to the drawings.

DETAILED DESCRIPTION OF EMBODIMENTS

Figure 1:
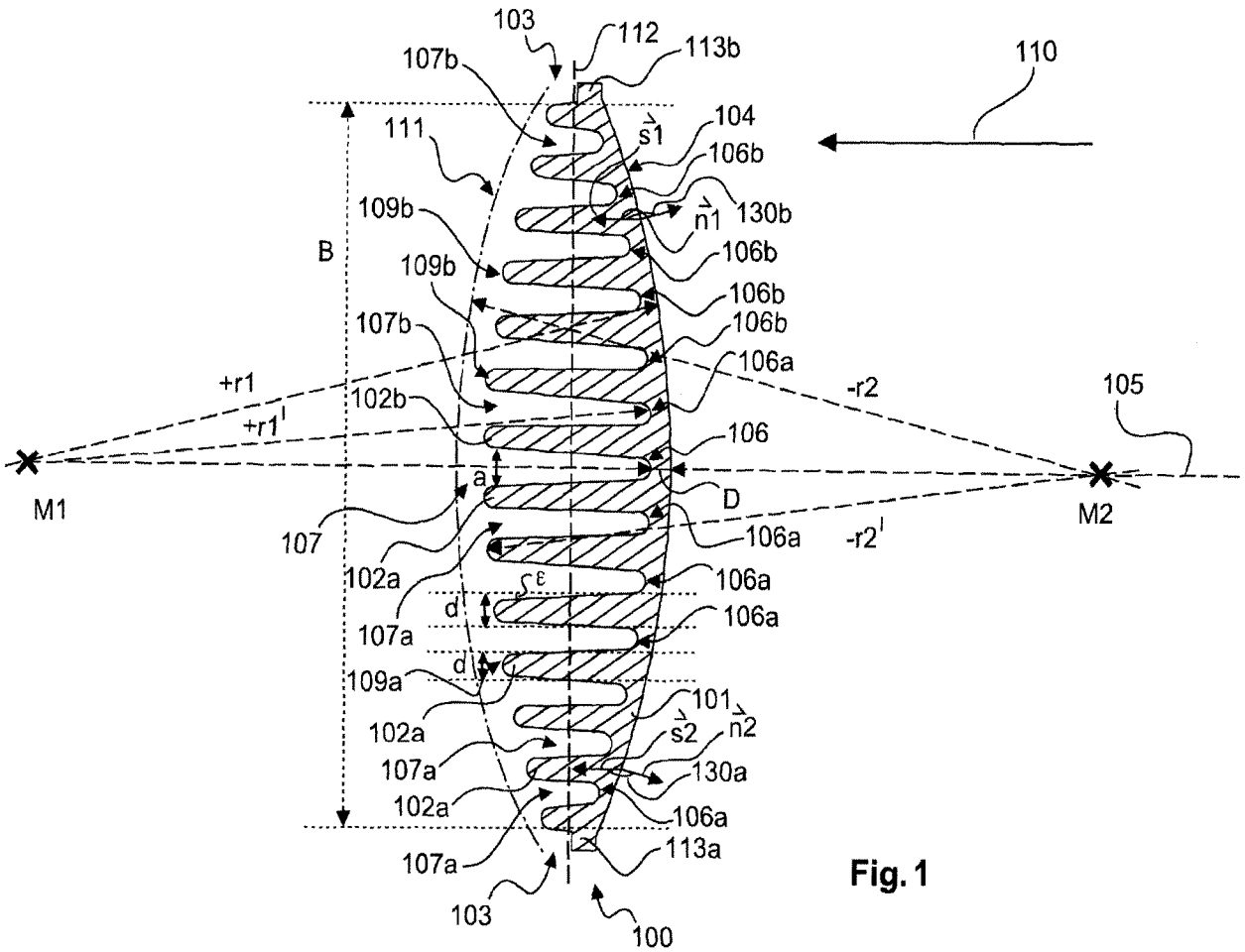
FIG. 1 is a cross section through an antenna cover according to an exemplary embodiment of the present invention.

The drawings are schematic and are not to scale. In the following description of FIGS. 1 to 9, the same reference numerals are used for identical or corresponding elements.

FIG. 1 is a cross section through an antenna cover according to an exemplary embodiment of the present invention. The antenna cover 100 has a first base body 101 and an even number of at least two first fins 102*a*, 102*b*. The even number of at least two fins forms the joining contour 103, joining means 103 or the attachment means 103. The base body 101 has the curved surface 104, which in an assembled state is one of the refraction surfaces of the finished lens. The refraction surface 104 can ensure a deflection of radiation 110 which passes through the antenna cover 100. The base body 101 and fins 102*a*, 102*b* are formed in one piece or are monolithic, as they are produced by injection moulding and form a common body of the antenna cover 100.

In the example of FIG. 1, the curved surface 104 is formed convex and can have a single radius of curvature or a plurality of radii of curvature. In the case of a plurality of radii of curvature, it is an aspherically curved surface 104, which can have differently curved regions. The curved surface 104 can have convex and/or concave regions. The antenna cover 100 is formed symmetrically with reference to a longitudinal axis of symmetry 105. In the case of concentrically arranged fins, the antenna cover can be rotationally symmetrical with reference to the axis of symmetry. In the case of fins running in parallel, the antenna cover 100 is formed in mirror symmetry with reference to a mirror plane, in which the axis of symmetry 105 lies, and which projects from the drawing plane. The lens may extend accordingly into the drawing plane or out of the drawing plane.

In FIG. 1, an antenna cover having only a single radius of curvature is shown. The curvature of the curved surface 104 has a radius of curvature +r1. The centre point M1 of the radius of curvature +r1 lies on the longitudinal axis of symmetry 105. In the case of an optical lens, the longitudinal axis of symmetry 105 can also be described as the optical axis 105.

The at least two fins 102*a*, 102*b* are arranged symmetrically to the longitudinal axis of symmetry 105 and substantially have a width d or thickness d. In this case the width d designates the width in a valley region 106*b*, 106*a*, 106 of the slots 107, 107*b*, 107*a*, gaps 107, 107*b*, 107*a* or spacings 107, 107*b*, 107*a*. The slots 107, 107*b*, 107*a* have substantially a width a, wherein the width a corresponds substantially to the thickness d of the fins. The shape of the fins 102*a*, 102*b* is formed so that these fins substantially fit into the slots 107, 107*a*, 107*b* without air inclusions. The fins 102*a*, 102*b* thus form a comb-like joining contour. Compared with the longitudinal axis of symmetry 105 or compared with a parallel to the longitudinal axis of symmetry 105, the fins have a draft angle ε, which can be 0.5° for example, or can lie in the range between 0.5° and 10°. In one example, a smallest possible thickness D of the base body 101 may be selected in order to facilitate good cooling of the base body 101 in an injection process. A small thickness D of the base body 101 can be realised, as the volume of the full body lens to be created is provided by the fins, which enter into the spacings a, 107, 107*a*, 107*b*. The spacing a may be selected to be smaller than D. Likewise the width d of a fin may be selected to be smaller than D. On account of the draft angle ε, the width d of a fin in the valley region 106, 106*a*, 106*b* is wider than in a crown region 109*a*, 109*b*. The width d of the fins thus decreases as the distance from the curved surface 104 or from the base body 101 increases. The spacing a of two adjacent fins accordingly increases as the distance from the base body 101 or from the curved surface 104 increases.

The curved surface 104 has a normal vector $n_1$, $n_2$, which with a vector $s_1$, $s_2$, which is oriented in the direction of extension of the fins 102*a*, 102*b*, encloses an angle 130*a*, 130*b*.

The angle 130*a*, 130*b* between the normal vector n1, n2 and fin vector s1, s2 lies in the range ]−90°, +90°[. In FIG. 1, the angle 130*b* may be +178°, for example, while the angle 130*a* is −177°.

In the valley region 106, 106*a*, 106*b*, the spacings 107, 107*a*, 107*b* or the gaps 107, 107*a*, 107*b* reach closest to the surface of the curved surface 104 and thus specify the thickness D of the base body 101. In other words, the distance of the valley regions 106, 106*a*, 106*b* from the surface of the curved surface 104 is at its smallest.

The fins 102*a*, 102*b* have the crown regions 109*a*, 109*b*, which at least in part have the greatest distance in each case of a constituent of the integrally formed antenna cover from the curved surface 104.

Starting out from the centre point Ml, which likewise represents the centre point of the radius +r1 of the curved surface 104, the valley regions 106, 106*a*, 106*b* lie on the radius +r1'. The length or the amount of the radius +r1' is smaller than the amount of the radius +r1. The difference between the radius +r1', on which the valley regions 106, 106*a*, 106*b* of the spacings 107, 107*a*, 107*b* lie, and the radius +r1 of the curved surface 104 amounts substantially to the wall thickness of the base body D.

Starting out from the direction of propagation of electromagnetic radiation, which is shown by the arrow 110 in FIG. 1 and runs parallel to the longitudinal axis 105 and to a longitudinal axis of the fins 102*a*, 102*b*, the radiation first strikes the curved surface 104 and then the assumed centre point M1 of the radius of curvature. The curved surface 104 is therefore a convex surface and the radii +r1, +r1' are assumed as positive values.

With a corresponding counterpart or a corresponding further antenna cover, a lens can be constructed by means of the antenna cover 100. A lens has two curved surfaces. However, since the antenna cover forms only a part of the lens, the progression of the curved surface of the further antenna cover is assumed as virtual line 111 or virtual curved surface 111. The curved surfaces 104 and 111 are arranged symmetrically to the axis of symmetry 112. With reference to the axis of symmetry 112, the mirror axis 112 or the mirror plane 112, which runs perpendicular to the axis of symmetry 105, a centre point M2 can be constructed, starting out from which a radius of curvature −r2 shapes the curve of the virtual curved second side 111 of the lens formed by the antenna cover 100. M1 and M2 are arranged in a mirror image to the axis of symmetry 112. In the case of an aspherically curved surface 104, the axis of symmetry 112 is the axis of symmetry of the aspherical curves. With regard to this virtual mirrored and curved surface 111, the crown regions 109*a*, 109*b* of the fins 102*a*, 102*b* run following this surface 111, less the wall thickness D of the further antenna cover, which corresponds to the wall thickness D of the base body of the antenna cover. The wall thickness of a second antenna cover (not shown in FIG. 1) is assumed as equal to the wall thickness D of the antenna cover 100. The curve of the crown regions 109*a*, 109*b* of the fins 102*a*, 102*b* is described by the radius −r2', which has the same centre point M2 as the radius of curvature −r2. In the case of fins arranged in a circle, the fins 102*a*, 102*b* designated by index a and b belong respectively to the same fin 102*a*, 102*b*. In the case of fins with a linear progression, the fins 102*a*, 102*b* are different fins.

The valley regions 106, 106*a*, 106*b* can be understood as support points of an "enveloping surface" or "envelope curve". The enveloping surface of the valley regions 106, 106*a*, 106 runs parallel to the curved surface 104 with a spacing of substantially D. With regard to the axis of symmetry 112 or plane of symmetry 112, the crown regions 109*a*, 109*b* run symmetrically on an enveloping surface that runs parallel to the virtual lens surface 111. The envelope curve or enveloping surface of the crown regions or apexes 109*a*, 109*b* runs symmetrically to the envelope curve of the valley regions 106, 106*a*, 106*b*. The envelope curve of the valley regions 106, 106*a*, 106*b* is described by the radius +r1', while the envelope curve of the crown regions 109*a*, 109*b* is described by the radius −r2'. The same applies to an aspherically shaped curved surface 104, 111. In other words, the crown regions 109*a*, 109*b* form support points, which have a similar progression to the curved surface 104. In another example, the valley regions 106, 106*a*, 106*b* or the crown regions 109*a*, 109*b* can lie on circular radii +r1', −r2', while the curved surfaces 104, 111 are formed aspherically.

Going beyond the width B, the antenna cover 100 has the attachment means 113*a*, 113*b*, which are implemented as attachment flanges 113*a*, 113*b* or antenna fastenings 113*a*, 113*b*. The attachment regions 113*a*, 113*b* can be used to fit sealing rings or O-rings as well as for attachment of the antenna cover 100 to a horn antenna (not shown in FIG. 1)

or to any other horn. The attachment means 113*a*, 113*b* can also be used to align the parts of the lens when assembling the lens. For example, a cup-shaped wall on the attachment means 213*a*, 213*b* can be used to serve as a guide for the attachment means 113*a*, 113*b*.

Figure 2:
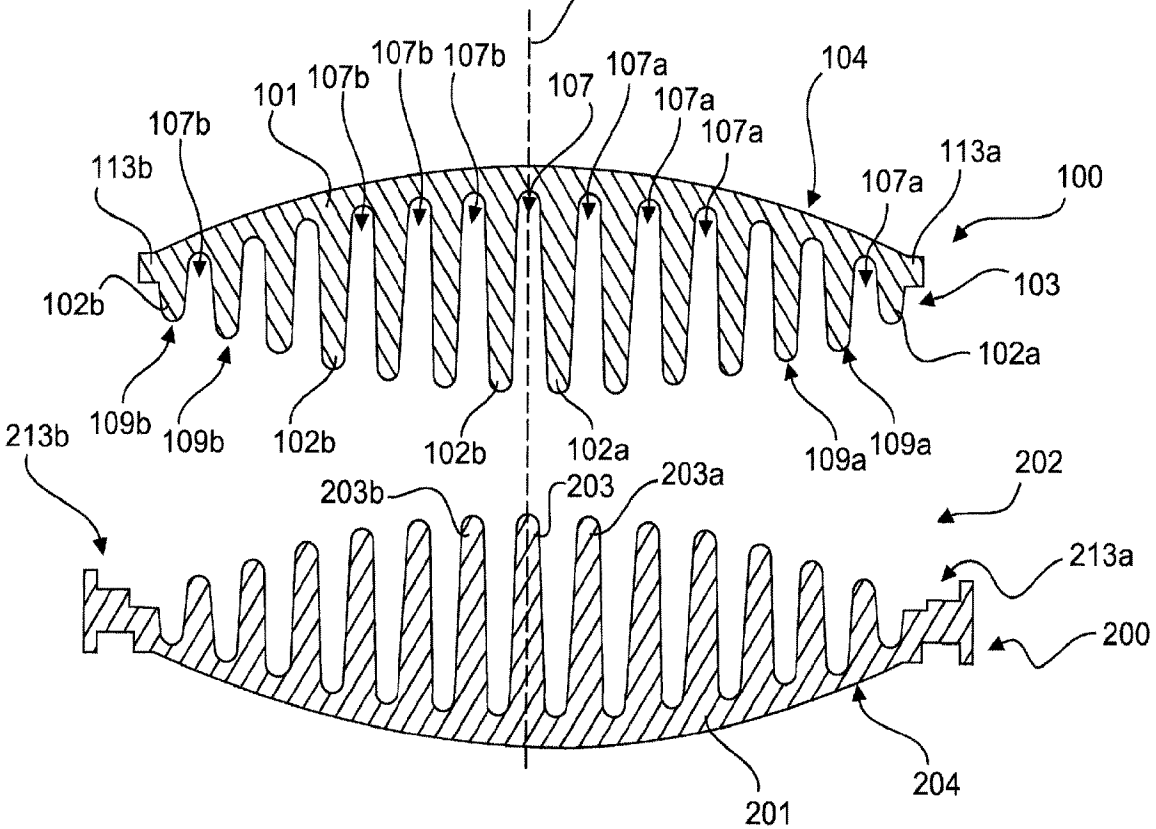
FIG. 2 is a cross section of a lens in a separated state according to an exemplary embodiment of the present invention.

FIG. 2 is a cross section of a lens in the separated state according to an exemplary embodiment of the present invention. FIG. 2 shows the antenna cover 100 and the further antenna cover 200. The further antenna cover 200 has a second base body 201 as well as a joining means 202 or joining contour 202, which has an odd number of second fins 203, 203*a*, 203*b*. In contrast to the spacing 107 present in the antenna cover 100 with respect to the longitudinal axis of symmetry 105, the further antenna cover 200 has the corresponding fin 203 or central fin 203. The fin 203 can engage with the spacing 107 or the gap 107 when the lens parts 100, 200 are joined together. A full lens can thus be formed, the curved surfaces 104, 204 of which are formed by the curved surface 104 of the first base body 101 and by the curved surface 204, which is provided by the second base body 201 of the further antenna cover 200. The attachment means 113*a*, 113*b* can engage with corresponding attachment means 213*a*, 213*b* of the second base body 201 and be used for alignment of the lens parts with one another. Free spaces in which condensate could collect are closed as far as possible.

Figure 3:
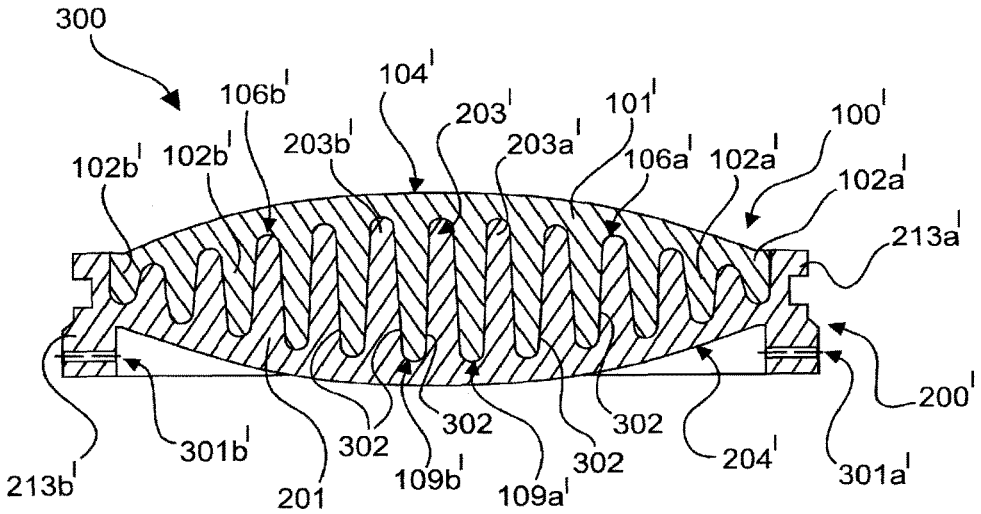
FIG. 3 is a cross section of an assembled lens according to an exemplary embodiment of the present invention.

FIG. 3 is a cross section of the assembled lens 300 or full lens 300 according to an exemplary embodiment of the present invention. The lens 300 has been formed by joining an antenna cover 100' to the base body 101' and the further antenna cover 200' to the base body 201'. The curved surfaces 104', 204' form the refraction surfaces of the lens 300. In FIG. 3, the antenna cover 100' used has no additional attachment regions 113*a*, 113*b*. Thus the width B of the antenna cover 100' is formed by the width of the fins and the spacings or gaps between the fins. The outermost fins 102*a*', 102*b*' are used for alignment and attachment. The outermost fins 102*b*', 102*a*' come to rest in the attachment means 213*b*' and 213*a*' of the further antenna cover 200'.

The further antenna cover 200' has openings 301*a*', 301*b*' in the attachment means 213*a*', 213*b*', which openings can be used to connect a fan for cleaning the lens 300. By joining the fins 102*a*', 102*b*' to the fins 203', 203*a*', 203*b*', a lens 300 is formed as a solid body. The joining interface 302, which runs substantially sinusoidally and is formed by the surfaces of the fins, may be substantially free of air inclusions following assembly, so that the lens has substantially the same properties as a lens produced in one piece. The joining interface 302 is formed from the surface of the attachment means 103, 202. To produce the lens in one piece, fins 102*a*, 102*b*, 201 of two corresponding lens halves are used as filling material. In FIG. 3, it can also be seen that the crown regions of the respective fins 102*a*', 102*b*', 203', 203*a*', 203*b*' substantially follow the contour of the surfaces 104', 204'. In one example, the crown regions follow spherical radii. The radii lie in the range of the wall thickness. The crown regions are designated 109*a*', 109*b*' and the valley regions are designated 106', 106*a*', 106*b*'. The crown regions of the fins correspond to the progression of the respective curved surface in each spatial region or in each spatial direction, that is to say both in the drawing plane and into the drawing plane or out of it. A good fit can thus be ensured when forming the full lens in all spatial directions.

Figure 4:
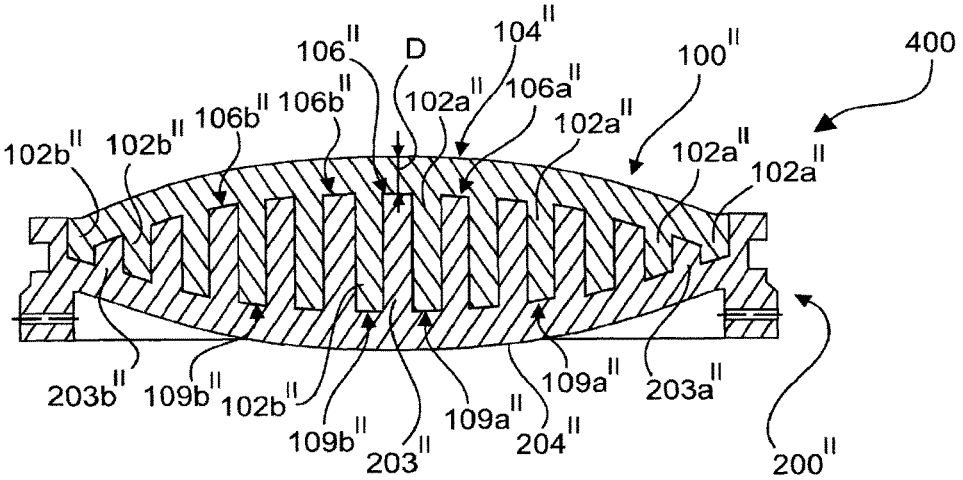
FIG. 4 is a cross section of an alternative lens according to an exemplary embodiment of the present invention.

FIG. 4 is a cross section of a further assembled lens according to an exemplary embodiment of the present invention. The lens 400 is formed in this case from the antenna cover 100" and 200". In contrast to the crown regions of the fins 203', 203*a*', 203*b*' and the valley regions 106*a*', 106*b*' of the fins 203', 203*a*', 203*b*', which are shown in FIG. 3 as rounded crown regions and valley regions, the fins 102*a*", 102*b*", 203", 203*b*", 203*a*" substantially have surfaces that run parallel to the surfaces 104", 204" and thus follow the surfaces 104", 204". They follow the surfaces in all spatial regions or spatial directions to ensure as few air inclusions as possible. In one region, the crown regions 109*a*", 109*b*" and valley regions 106", 106*a*", 106*b*" follow the radii +r1', −r1'. The entire surface curve 109*a*", 109*b*" and the surface curve 106", 106*a*", 106*b*"consequently follow the radii +r1', −r2' and not only one crown region or one valley region. The same applies to the other lens half 200". The fins 102*a*", 102*b*", 203', 203*a*', 203*b*' taper as the spacing from the respective base body of the antenna covers 100", 200" increases.

Figure 5:
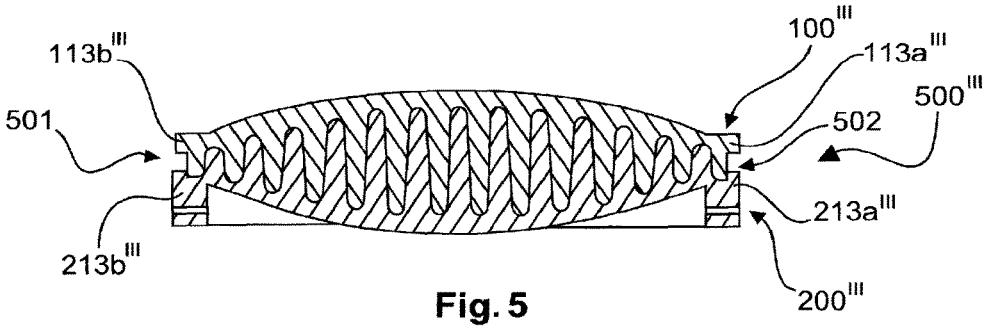
FIG. 5 is a cross section of a lens that is prepared for the use of a horizontal seal according to an exemplary embodiment of the present invention.

FIG. 5 shows a lens 500'", which is prepared for use by means of a horizontal seal, according to an exemplary embodiment of the present invention. Serving as basis for the construction of the lens 500'" are the lens parts 100, 200, which are to be inferred from FIG. 2 as the antenna cover 100 and the further antenna cover 200. In the case of the lens 500'", due to the interaction of the attachment means 113*a*'", 113*b*'", 213*a*'", 213*b*'" recesses 501, 502 are present, on which a horizontal O-Ring or a horizontal sealing ring can be fitted for sealing purposes if the lens 500'" is installed in a horn antenna. The recesses 501, 502 are a single recess or groove, which is formed as a circumferential ring around the entire lens-shaped antenna cover 500'". The recess is formed between the two antenna covers.

Figure 6:
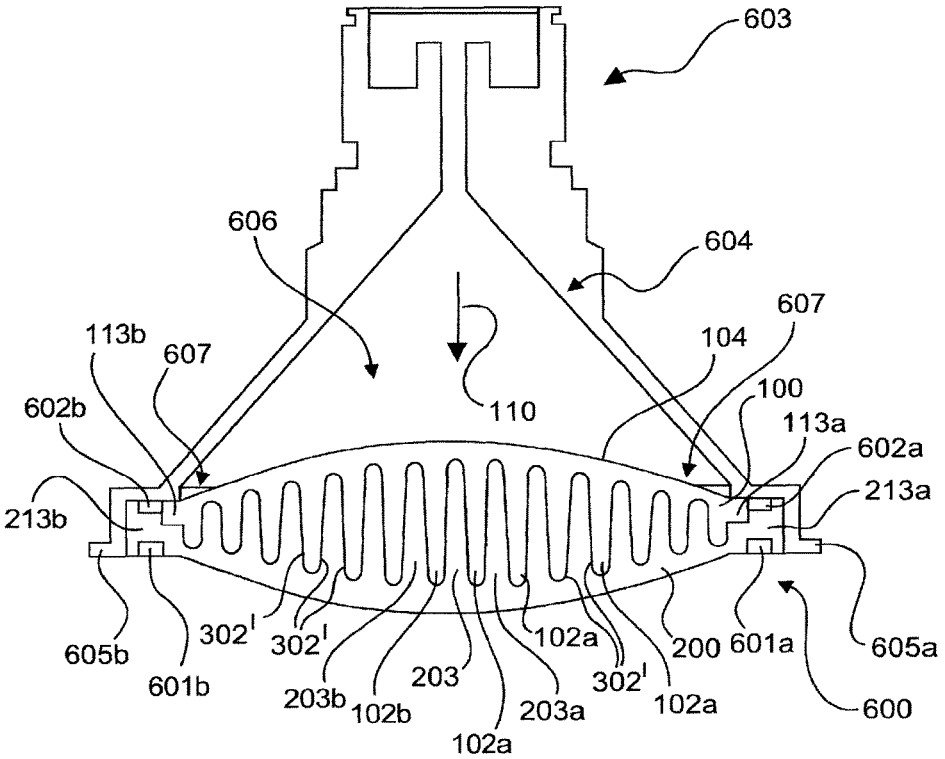
FIG. 6 is a cross section of a lens installed in a horn antenna of a fill level measuring device according to an exemplary embodiment of the present invention.

FIG. 6 is a cross section of a lens 600 installed in a horn antenna or lens antenna of a fill level measuring device according to an exemplary embodiment of the present invention. The lens 600 is a lens formed by assembly of the antenna cover 100 and the further antenna cover 200 from FIG. 2. The attachment devices 113*a*, 213*a* and 113*b*, 213*b* interact in such a way that recesses 601*a*, 601*b* and 602*a* and 602*b* are created, into which sealing rings can be inserted. The recesses 601*a*, 601*b* and 602*a* and 602*b* can also be circumferential.

The antenna 603 has the horn-shaped antenna opening 604 or the widened antenna region 604, which expands in the direction of the lens 600. The assembled lens 600 is fastened in the attachment means 605*a*, 605*b* of the antenna opening 604 with the aid of the attachment means 113*a*, 213*a*, 113*b*, 213*b* provided on the lens 600, so that the cavity 606 is protected from penetrating particles. The attachment means 605*a*, 605*b* of the antenna opening 604 is formed as a circumferential flange. The attachment means 113*a*, 213*a*, 113*b*, 213*b* of the lens is formed rectangular or square, in order to be able to attach the lens surface securely in the antenna opening 604. The arrow 110 indicates the direction of an electromagnetic wave propagating in the direction of a filling material, which wave has been generated by a high-frequency device (not shown in FIG. 6) and which is used to measure the distance of a fill level. The electromagnetic wave first strikes the surface 104 of the antenna cover, then passes the solid body of the lens 600 formed from the fins 102*a*, 102*b* of the antenna cover 100 and the fins 203, 203*a*, 203*b* of the further antenna cover 200. The electromagnetic wave exits the lens body via the curved surface of the further antenna cover 200. In FIG. 6, the progression of the joint 302' can likewise be seen. The width of the opening 607 of the waveguide 603 substantially corresponds to the width B of the antenna cover 100, 200. The attachment devices 113*a*, 213*a* and 113*b*, 213*b* can be used to match the width of the lens 600 to the antenna exit opening 607 or aperture 607.

Figure 7:
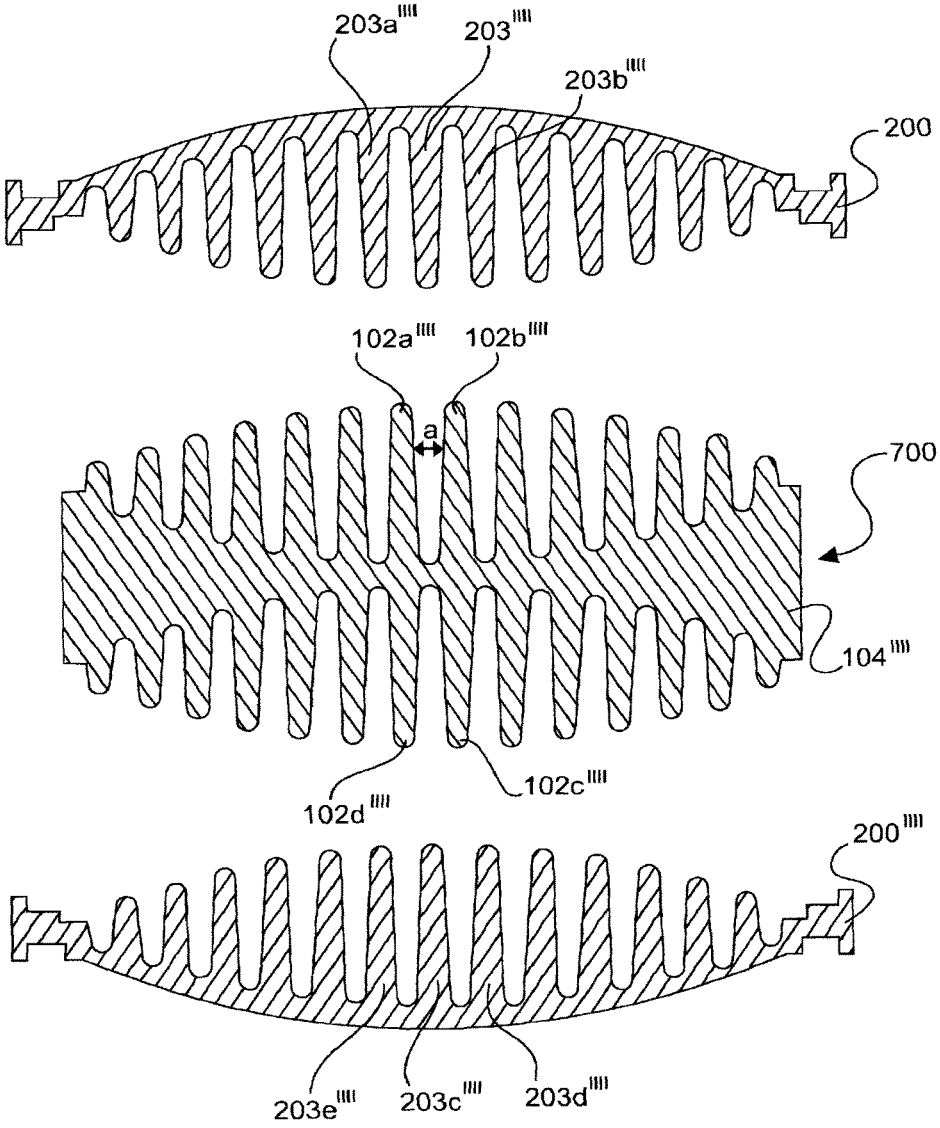
FIG. 7 is a cross section of an adapter and two antenna covers according to an exemplary embodiment of the present invention.

FIG. 7 is a cross section of an adapter 700 and two further antenna covers 200, 200"" according to an exemplary embodiment of the present invention. The adapter 700 has a plurality of fins 102*a*"", 102*b*"", 102*c*"", 102*d*"", which are arranged on the base body 104"". In one approach, the adapter 700 is two symmetrically joined antenna covers 100, so that the curve of the crown regions and of the valley regions of the adapter 700 substantially corresponds to the curves described in FIG. 1. The same applies to the dimensioning. The adapter 700 can be used to form a lens in assembled form by means of a further antenna cover 200, 200"". The combination of the fins 102*a*"", 102*b*"", 102*c*"", 102*d*"" and 203"", 203*a*"", 203*b*"" and 203*c*"", 203*d*"" and 203*e*"" and the base body 104"" form the solid body of the lens 700. To create good conditions for the injection process, the adapter is also formed with a wall thickness that is as constant as possible. Due to the uniform construction, a homogeneous body can be formed. The cuneiform progression of the base body of the adapter is possible if the granulate is injected from the side in the injection moulding process.

Figure 8:
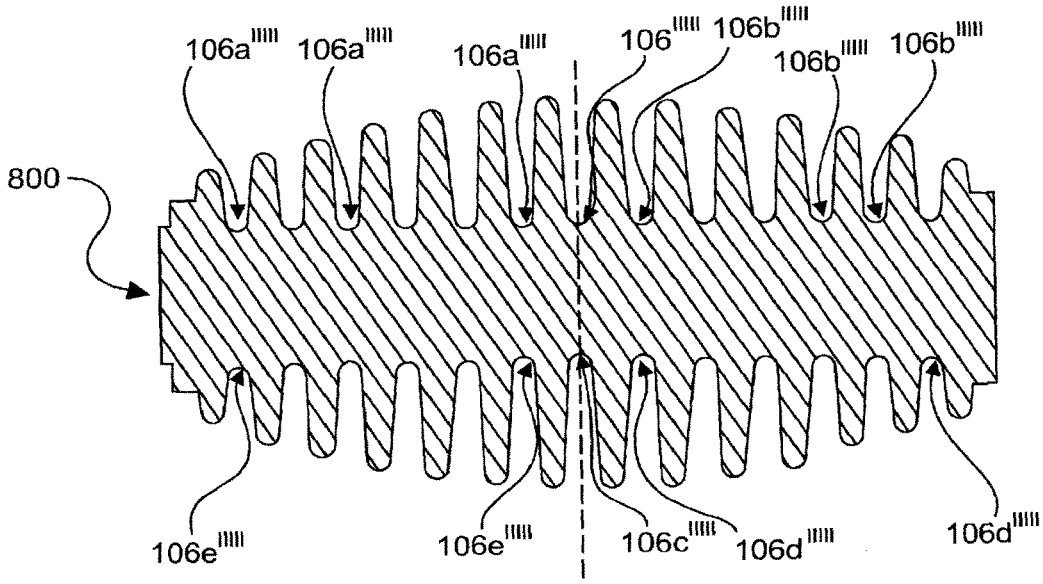
FIG. 8 is a cross section of a further adapter according to an exemplary embodiment of the present invention.

FIG. 8 is a cross section of a further adapter according to an exemplary embodiment of the present invention. In the adapter 800, the valley regions 106"", 106*a*"", 106*b*"", 106*c*"", 106*d*"", 106*e*"" do not run along a curved surface, but substantially on a plane. The crown regions of the fins, however, run likewise on curved envelope curves, which correspond to the curved surfaces of the lenses.

When producing a cover using an injection moulding process, an injection mould is provided at the beginning, which makes possible the production of the antenna cover device 100 and/or of an adapter 800, 700. An injection mould is a negative mould of the antenna cover and/or of the respective adapter. The granulate from which the antenna cover 100 and/or the adapter 700, 800 is to be produced is also provided. The granulate is melted and injected into the injection mould, whereby the antenna cover and/or the adapter is formed. Following cooling, the antenna cover and/or the adapter can be removed from the injection mould.

Figure 9:
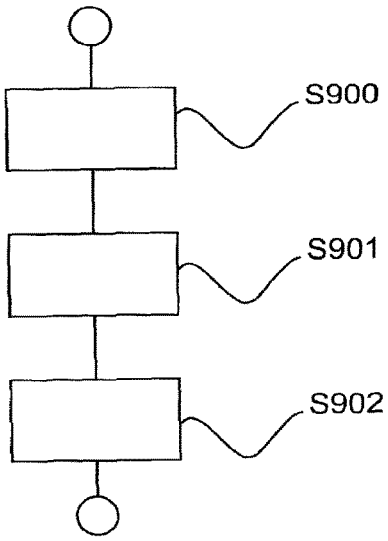
FIG. 9 is a flow chart for a method for the production of a cover from two antenna cover halves according to an exemplary embodiment of the present invention.

FIG. 9 is a flow chart for a production method for a full lens from lens halves. When producing the full lens from the lens parts 100, 200, a first antenna cover 100 with an even number of fins is provided in a step S900. In step S901, a second antenna cover 200 with an odd number of fins is provided. In step S902, the joining of the two antenna covers takes place in that the comb-shaped attachment means 103, 202 are applied to one another in such a way that the central fin 203 of the antenna half 200 with an odd number of fins enters into the spacing 107 of the antenna half 100 with an even number of fins. For a better hold and to avoid air inclusions, an adhesive can be used between the joining structures 103, 202.

In addition, it should be pointed out that "comprising" and "having" do not exclude any other elements or steps and "a" does not exclude a plurality. Furthermore, it should be pointed out that features or steps that have been described with reference to one of the above embodiments can also be used in combination with other features or steps of other embodiments described above. Reference numerals in the claims are not to be regarded as a limitation.

The invention claimed is:

1. An antenna cover, comprising:

a first base body having a curved surface; and at least two first fins arranged on the first base body, the at least two first fins being arranged symmetrically to a longitudinal axis of symmetry of the antenna cover and extending substantially parallel to the longitudinal axis of symmetry, the at least two first fins having a width that tapers as a distance from the first base body increases, the at least two first fins being arranged with a spacing that substantially corresponds to the width of the at least two first fins, each of the at least two first fins having a crown region that follows a virtual mirrored curved surface of the first base body and that is less than a thickness of the first base body, and the virtual mirrored curved surface of the first base body and the curved surface of the first base body having a mirror axis and/or a mirror plane, which runs perpendicular to the longitudinal axis of symmetry.

2. The antenna cover according to claim 1, wherein the curved surface has an aspherical curvature.

3. The antenna cover according to claim 1, further comprising an even number of the at least two first fins.

4. The antenna cover according to claim 1, wherein the longitudinal axis of symmetry lies in a plane of symmetry, and wherein the first base body and the at least two first fins are arranged in minor symmetry to the plane of symmetry.

5. The antenna cover according to claim 1, wherein the at least two first fins are arranged in a comb-like manner along another width of the first base body.

6. The antenna cover according to claim 1, wherein the spacing between the at least two first fins has a valley region, and wherein the valley region lies on a parallel surface to the curved surface of the first base body.

7. The antenna cover according to claim 1, further comprising:

a second antenna cover, having a second base body and a plurality of second fins, a number of the plurality of second fins differs by a value of 1 from a number of the at least two first fins, the plurality of second fins having a width that substantially corresponds to the spacing between the at least two first fins and that tapers as a distance from the second base body increases, the plurality of second fins being arranged with the spacing that substantially corresponds to the width between the at least two first fins, and the plurality of second fins engages according to the number of the plurality of second fins in each case in the spacing.

8. The antenna cover according to claim 1, wherein the at least two first fins are arranged as concentric circles and/or as parallel fins.

9. The antenna cover according to claim 6, wherein the width of the at least two first fins substantially corresponds to the thickness of the first base body in an area of the valley region of the spacing.

10. The antenna cover according to claim 1, wherein the cover is in a shape of a lens.

11. An antenna for a measuring device, the antenna comprising an antenna cover, the antenna cover comprising:

a first base body having a curved surface; and at least two first fins arranged on the first base body, the at least two first fins being arranged symmetrically to a longitudinal axis of symmetry of the antenna cover and extending substantially parallel to the longitudinal axis of symmetry, the at least two first fins having a width that tapers as a distance from the first base body increases, the at least two first fins being arranged with a spacing that substantially corresponds to the width of the at least two fins, each of the at least two first fins having a crown region that follows a virtual mirrored curved surface of the first base body and that is less than a thickness of the first base body, and the virtual mirrored curved surface of the first base body and the curved surface of the first base body having a mirror axis and/or a mirror plane, which runs perpendicular to the longitudinal axis of symmetry.

12. A method for producing a lens-shaped antenna cover, comprising:

providing a first antenna cover, comprising a first base body having a curved surface; and at least two first fins arranged on the first base body, the at least two first fins being arranged symmetrically to a longitudinal axis of symmetry of the first antenna cover and extending substantially parallel to the longitudinal axis of symmetry, the at least two first fins having a width that tapers as a distance from the first base body increases, the at least two first fins being arranged with a spacing that substantially corresponds to the width of the at least two first fins, each of the at least two first fins having a crown region that follows a virtual mirrored curved surface of the first base body and that is less than a thickness of the first base body, the virtual mirrored curved surface of the first base body and the curved surface of the first base body having a mirror axis and/or a mirror plane, which runs perpendicular to the longitudinal axis of symmetry, and the first antenna cover having an even number of fins;

providing a second antenna cover, comprising a second base body having the curved surface; and at least two second fins arranged on the second base body, the at least two second fins being arranged symmetrically to the longitudinal axis of symmetry of the second antenna cover and extending substantially parallel to the longitudinal axis of symmetry, the at least two second fins having a width that tapers as a distance from the second base body increases, the at least two second fins being arranged with a spacing that substantially corresponds to the width of the at least two second fins, each of the at least two second fins having a crown region that follows a virtual mirrored curved surface of the second base body and that is less than a thickness of the second base body, the virtual mirrored curved surface of the second base body and the curved surface of the second base body having a mirror axis and/or a mirror plane, which runs perpendicular to the longitudinal axis of symmetry, and the second antenna cover having an odd number of fins; and joining the first antenna cover and the second antenna cover so that the at least two first fins of the first antenna cover are disposed in spacings of the second antenna cover, and the at least two second fins of the second antenna cover are disposed in spacings of the second antenna cover.

* * * * *